US008111849B2

(12) United States Patent
Tateno et al.

(10) Patent No.: US 8,111,849 B2
(45) Date of Patent: Feb. 7, 2012

(54) HEARING AID

(75) Inventors: Makoto Tateno, Kokubunji (JP); Katsuya Nakao, Kokubunji (JP)

(73) Assignee: Rion Co., Ltd., Tokyo (JP)

( * ) Notice: Subject to any disclaimer, the term of this patent is extended or adjusted under 35 U.S.C. 154(b) by 1173 days.

(21) Appl. No.: 11/886,495

(22) PCT Filed: Feb. 15, 2007

(86) PCT No.: PCT/IB2007/000351

§ 371 (c)(1),
(2), (4) Date: Sep. 17, 2007

(87) PCT Pub. No.: WO2007/099420

PCT Pub. Date: Sep. 7, 2007

(65) Prior Publication Data

US 2008/0192971 A1 Aug. 14, 2008

(30) Foreign Application Priority Data

Feb. 28, 2006 (JP) ..... 2006-052558

(51) Int. Cl.
*H04R 25/00* (2006.01)

(52) U.S. Cl. ..... 381/317; 381/318; 381/71.6; 381/71.11

(58) Field of Classification Search ..... 381/317, 381/312, 318, 71.6, 71.11, 71.12, 93, 94.1
See application file for complete search history.

(56) References Cited

U.S. PATENT DOCUMENTS

| | | | | |
|---|---|---|---|---|
| 4,596,902 | A | 6/1986 | Gilman | |
| 5,481,615 | A | 1/1996 | Eatwell et al. | |
| 5,987,146 | A | 11/1999 | Pluvinage et al. | |
| 6,275,596 | B1 | 8/2001 | Fretz et al. | |
| 6,658,122 | B1 | 12/2003 | Westermann et al. | |
| 2003/0012391 | A1 * | 1/2003 | Armstrong et al. | 381/312 |
| 2005/0265568 | A1 * | 12/2005 | Kindred | 381/318 |

FOREIGN PATENT DOCUMENTS

| | | |
|---|---|---|
| DE | 2808516 | 9/1979 |
| JP | 2001-508261 | 6/2001 |
| WO | WO 9423419 | 10/1994 |
| WO | WO 0028784 | 5/2000 |
| WO | WO 2004021740 A1 * | 3/2004 |

* cited by examiner

*Primary Examiner* — Jerome Jackson, Jr.
*Assistant Examiner* — Yu Chen
(74) *Attorney, Agent, or Firm* — Carrier Blackman & Associates, P.C.; Joseph P. Carrier; William D. Blackman

(57) ABSTRACT

A hearing aid which achieves a comfortable feeling to use while preventing generation of howling includes a microphone for converting an environmental sound to an electric signal, a hearing aid processor for hearing aid processing of an output signal of the microphone, an earphone for converting an output signal of the hearing aid processor to a sound signal, an external ear canal microphone converting a sound within an external ear canal to an electric signal, and an adaptive filter for comparing an output signal of the external ear canal microphone and the output signal of the hearing aid processor to automatically adjust the output signal of the hearing aid processor in such a manner that the output signal of the external ear canal microphone approaches the output signal of the hearing aid processor. The output signal of the hearing aid processor functions as an input signal and a desired signal of the adaptive filter, and the output signal of the external ear canal microphone functions as a response signal of the adaptive filter.

10 Claims, 2 Drawing Sheets

HEARING AID

CROSS-REFERENCE TO RELATED APPLICATIONS

The present application is a U.S. National phase of, and claims priority based on PCT/IB2007/000351, filed 15 Feb. 2007, which, in turn, claims priority from Japanese patent application 2006-052558, filed 28 Feb. 2006. The entire disclosure of each of the referenced priority documents is incorporated herein by reference.

TECHNICAL FIELD

The present invention relates to a hearing aid which achieves a comfortable feeling to use by reducing an uncomfortable feeling due to occlusion of an external ear canal.

BACKGROUND ART

Generally, a sound of the hearing aid is hard in tone due to an echo effect by occluding the external ear canal and has a tendency of an impulsive sound to be emphasized. Therefore, there may be cases where it is not comfortable for wearers of hearing aids. Further, when sound pressures of wearers' personal voices are radiated in the occluded external ear canal via bone conduction, the personal voices may be unnaturally amplified so as to give an unnatural feeling that something is wrong. In conventionally employed methods for removing the uncomfortable feelings caused by occluding the external ear canal, the external ear canal is opened as much as possible, namely, like an open fitting, whereby the uncomfortable feeling may be reduced (for example, see patent references 1-3).

Patent reference 1: Japanese patent application publication No. 2001-508261

Patent reference 2: U.S. Pat. No. 6,275,596

Patent reference 3: U.S. Pat. No. 5,987,146

Problem to be Solved by the Invention

As described in patent references 1-3, however, the more opened the external ear canal is, the easier to return to a microphone the sound pressure outputted from an earphone becomes, so that the acoustic feedback (howling) is necessarily liable to be generated. Thus, as it is impossible to transmit an adequate sound pressure to an eardrum, there is such a disadvantage that the application is limited mainly to a mild hearing loss (a moderate loss, at the most).

The present invention is made in view of the disadvantage as mentioned above and it is therefore an object of the present invention to provide a hearing aid capable of obtaining a comfortable feeling to use even if an external ear canal is occluded for preventing the generation of acoustic feedback.

SUMMARY OF THE INVENTION

To solve the above mentioned disadvantage, in accordance with a first aspect of the present invention, a hearing aid which has a microphone for converting an environmental sound to an electric signal, a hearing aid processor for hearing aid processing of an output signal of the microphone, and an earphone for converting an output signal of the hearing aid processor to a sound signal, comprises an external ear canal microphone for converting a sound within an external ear canal to an electric signal, and a signal processor for comparing an output signal of the external ear canal microphone and the output signal of the hearing aid processor and for automatically adjusting the output signal of the hearing aid processor in such a manner that the output signal of the external ear canal microphone approaches the output signal of the hearing aid processor.

In accordance with a second aspect of the present invention, in the hearing aid of the first aspect, the signal processor comprises an adaptive filter, the output signal of the hearing aid processor functions as an input signal xk and a desired signal dk of the adaptive filter, and the output signal of the external ear canal microphone functions as a response signal yk of the adaptive filter.

In accordance with a third aspect of the present invention, the hearing aid of the second aspect further comprises a delay device for having the desired signal dk delayed for a predetermined time.

In accordance with a fourth aspect of the present invention, the hearing aid of the second or third aspect further comprises an amplitude adjusting device for monitoring an impulse response of the adaptive filter and, when a maximum value (peak value) of the impulse response exceeds a predetermined value, adjusting automatically either one or more of four amplitudes with respect to the output signal of the microphone, the output signal of the hearing aid processor, the output signal of the external ear canal microphone and a driving signal of the earphone.

In accordance with the fifth aspect of the present invention, the hearing aid of the third or fourth aspect further comprises a delay amount controller for monitoring the impulse response of the adaptive filter and, when a maximum value in the beginning part of the impulse response is below a predetermined value, decreasing a delay amount of the delay device.

In accordance with the sixth aspect of the present invention, the hearing aid of any one of the first to fifth aspect further comprises a frequency weighting device for imposing a predetermined frequency weight on to remove from the output signal of the external ear canal microphone a component of sound signal propagated from a vent into an external ear canal.

In accordance with the seventh aspect of the present invention, the hearing aid of any one of the first to sixth aspect further comprises a frequency characteristic correcting device for correcting the frequency response of the external ear canal microphone.

Effects of the Invention

According to the first aspect of the invention, the quality of sound within the external ear canal is able to approach the quality of sound of the hearing aid processed with respect to the environmental sound, so that the uncomfortable feeling due to the occluding of the external ear canal can be reduced. Then, as the external ear canal itself is in an occluded condition, the acoustic feedback (howling) does not occur even if the adequate sound pressure is transmitted to the eardrum.

According to the second aspect of the invention, the transfer characteristic due to the occluding of the external ear canal is corrected by the adaptive filter so that the transient characteristic can be improved to make the naturalness and the intelligibility better. Also, there is possibility that the unnaturalness (i.e. the indistinct feeling) by radiating the personal (own) voice of the hearing aid wearer within the external ear canal is able to be corrected, because the personal voice within the external ear canal acts in the direction to be cancelled by the adaptive processing. Further, as the external ear canal itself is hermetically sealed, the howling does not occur even if the adequate sound pressure is transmitted to the eardrum.

According to the third aspect of the invention, it is possible to reduce the complexity of the adaptive filter that is beneficial for an efficient signal processing.

According to the fourth aspect of the invention, the sound pressure supplied into a space of the external ear canal can be kept in the optimum conditions regardless of the size of volume with respect to the space of the hermetically sealed external ear canal, and a processing element of the adaptive filter can be prevented from calculation overflow.

According to the fifth aspect of the invention, the delay amount of the system can be kept in the minimum value so that the difference in reaching time to the eardrum relative to the sound which does not pass the hearing aid may be controlled at the minimum so as to reduce the feeling of wrongness when wearing the hearing aid on one ear.

According to the sixth aspect of the invention, the adaptive filter can be prevented from canceling the sound transmitted from the vent.

According to the seventh aspect of the invention, it is possible to reduce the influence due to the frequency characteristic of the external ear canal microphone which monitors the sound pressure within the external ear canal.

DESCRIPTION OF BEST MODE FOR CARRYING OUT THE INVENTION

An embodiment of the present invention will now be explained with reference to the accompanying drawings. Herein, FIG. 1 is a schematic explanatory view of a hearing aid according to the present invention and FIG. 2 is a block diagram of the structure thereof.

Figure 1:
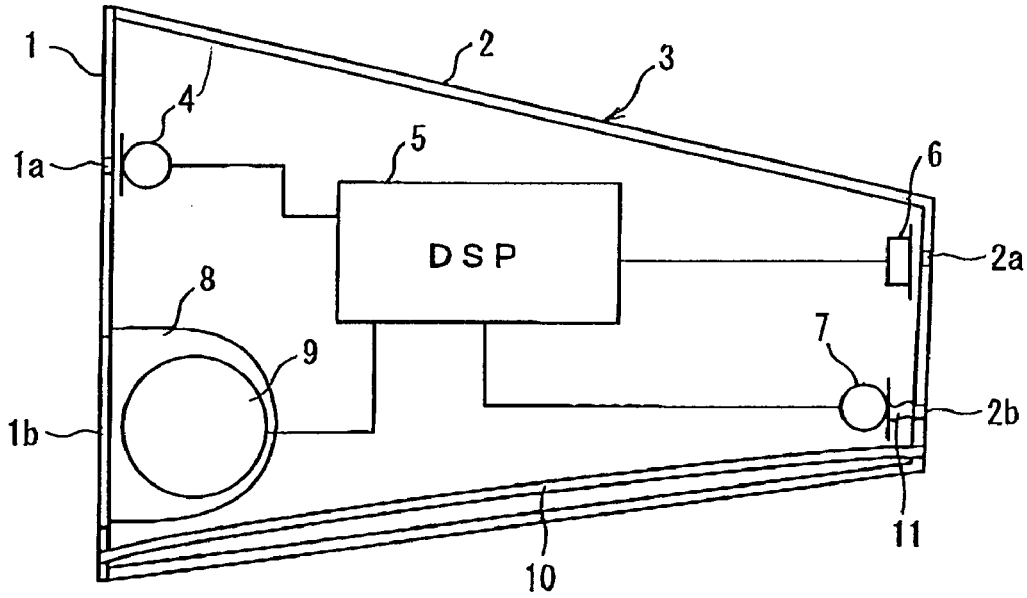
FIG. 1 is a schematic explanatory view of a hearing aid according to the present invention.

A hearing aid according to the present invention, as shown in FIG. 1, has a casing 3 formed with a face plate 1 and a shell 2. Within the casing 3, there are housed a microphone 4, a digital signal processor 5 (hereinafter, referred to as DSP), an earphone 6, an external ear canal microphone 7, and a button battery 9 held by a battery holder 8. The face plate 1 is formed with an input sound port 1*a* for transmitting an environmental sound to the microphone 4, an opening portion 1*b* for opening and closing the battery holder 8, etc. The shell 2 is formed with an output sound port 2*a* for transmitting a sound outputted by the earphone 6 to an external ear canal, and an external ear canal sound port 2*b* for transmitting a sound within the external ear canal to the external ear canal microphone 7.

The external ear canal microphone 7 is connected through a tube 11 to the external ear canal port 2*b*, but it is possible to dispense with the tube 11 in the case where there is an enough space for having arranged the external ear canal microphone 7 around the external ear sound port 2*b*. Further, In the casing 3 there is formed a vent 10 which communicates, when wearing the hearing aid, between an external sound environment and the external ear canal in accordance with the hearing acuity characteristic of the hearing aid wearers. Herein, the external ear sound port 2*b* may be formed in a wall of the vent 10 facing the inside of the casing 3.

Figure 2:
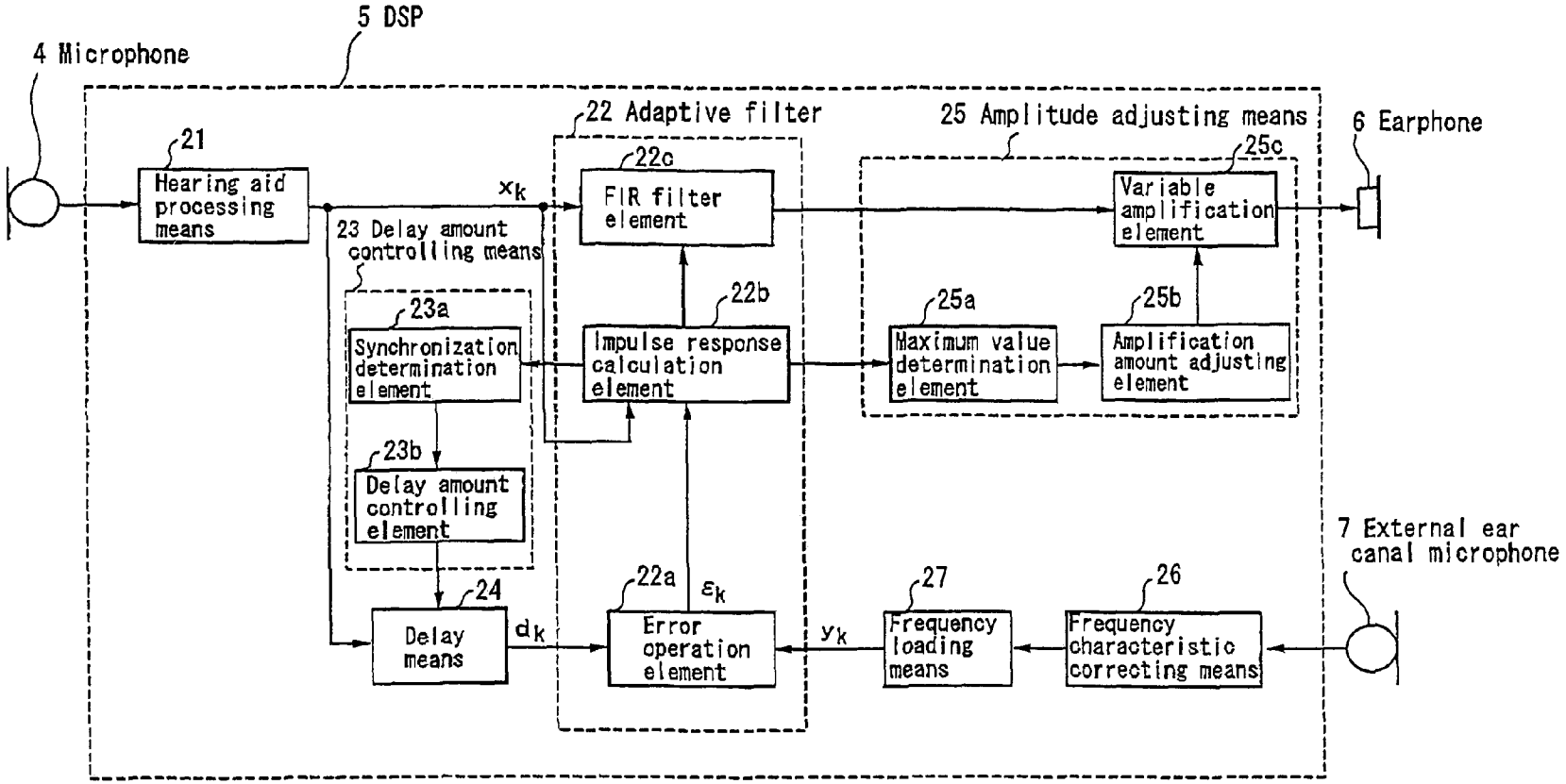
FIG. 2 is a block diagram showing the structure of the hearing aid according to the present invention.

As shown in FIG. 2, the DSP 5 comprises a hearing aid processing means or processor 21, an adaptive filter (a signal processing means) 22, a delay amount controlling means or controller 23, a delay means or device 24, an amplitude adjusting means or device 25, a frequency characteristic correcting means or device 26 and a frequency weighting means or device 27. The hearing aid processing means 21 carries out hearing aid processing in accordance with the hearing acuity characteristic of the hearing aid wearers and an environment of use, such as multi-band compression and noise reduction, tone control, volume control, output limiting, etc. with respect to an output signal of the microphone 4 so as to output a hearing aid signal fit for the hearing aid wearers.

The adaptive filter 22 comprises an error operation element 22*a*, an impulse response calculation element 22*b* and an FIR filter element 22*c*. A couple of desired signal dk and response signal yk are inputted to the error operation element 22*a* so that the error operation element 22*a* outputs a signal $\epsilon k$ in accordance with the amount of the error $\epsilon k$ (=dk−yk). The impulse response calculation element 22*b* calculates an impulse response of the FIR filter element 22*c* such that the value of the error signal $\epsilon k$ outputted from the error operation element 22*a* becomes minimum. An impulse response of the FIR filter element 22*c* is variable and varied to the impulse response outputted from the impulse response calculation element 22*b* while an input signal xk inputted to the FIR filter element 22*c* is filter-processed by a filter formed by the impulse response.

The delay amount controlling means 23 comprises a synchronization determination element 23*a* and a delay amount controlling element 23*b*. The synchronization determination element 23*a* monitors the beginning part of the impulse response which is outputted from the impulse response calculation element 22*b*, so as to carry out comparative determination between a coefficient of the beginning part and a predetermined value. The delay amount controlling element 23*b* controls a delay amount of the delay means 24 based on the determination result of the synchronization determination element 23*a*.

The amplitude adjusting means 25 comprises a maximum value determination element 25*a*, an amplification amount adjusting element 25*b* and a variable amplification element 25*c*. The maximum value determination element 25*a* monitors the maximum value of the impulse response outputted from the impulse response calculation element 22*b* to carry out comparative determination with a predetermined value. Based on the determination result of the maximum value determination element 25*a* the amplification amount adjusting element 25*b* varies an amplification gain of the variable amplification element 25*c*. Herein, the variable amplification element 25*c* may be provided, in addition to the location where a driving signal of the earphone 6 is amplified, in locations where the output signal of the microphone 4 is amplified, where the output signal of the hearing aid processing means 21 is amplified, and where the output signal of the hearing aid processing means 21 is amplified.

The frequency characteristic correcting means 26 corrects the frequency characteristic due to the tube 11 and the external ear canal microphone 7. The frequency weighting means 27 corrects the vent effect by a low cut filter. If this processing is not carried out, in the hearing aid of the present invention which has the vent 10 it operates to cancel the sound signal of low frequency which is let into the external ear canal via the vent 10. Also, the frequency weighting means 27 may be interposed between the error operation element 22*a* and the impulse calculation element 22*b*.

The operation of the hearing aid according to the present invention constructed as above will be explained hereunder. The environmental signal outputted from the microphone 4 is hearing aid processed by the hearing aid processing means 21 to fit the hearing aid wearer. The hearing aid signal that is hearing aid processed and outputted by hearing aid processing means 21 is diverged to be an input signal xk of the FIR filter element 22*c* on one side and an input signal of the delay means 24 on the other side. The hearing aid signal xk inputted into the FIR filter element 22*c* is processed by transfer function and thereafter inputted into the variable amplification element 25*c* as an output signal of the adaptive filter 22 so as to be amplified at a predetermined amplification gain. Then, the hearing aid signal amplified by the variable amplification element 25*c* is converted to acoustic sound by the earphone 6 so as to be emitted into the external ear canal as a sound signal.

The sound within the external ear canal is let in from the external ear canal microphone 7 and outputted as an external ear sound signal. The external ear sound signal outputted from the external ear canal microphone 7 is inputted into the frequency characteristic correcting means 26 so that the frequency characteristic due to the tube 11 and the external ear canal microphone 7 is corrected. In order to have the external ear canal sound signal precisely approached to the hearing aid signal, it is preferable to correct the external ear canal signal by the frequency characteristic correcting means 26. However, since another FIR filter is required for this and a burden of operation volume is imposed thereon, it may be omitted without injuring the real nature of the present invention. The external ear canal signal whose frequency characteristic is corrected by the frequency characteristic correcting means 26 is inputted into the frequency weighting means 27 so as to correct the vent effect by the low cut filter.

The external ear canal signal processed by the frequency weighting means 27 is inputted into the error operation element 22*a* as a response signal yk of the adaptive filter 22 at the same level of time delay as the hearing aid signal (the desired signal of the adaptive filter 22) dk which is delayed for a time predetermined by the delay means 24. The hearing aid signal dk and the external ear canal sound signal yk are compared by the error operation element 22*a* while the difference between them is inputted into the impulse response calculation element 22*b* as the error signal $\epsilon k$ (=dk−yk). The impulse response calculation element 22*b* makes reference to xk and $\epsilon k$ and renews in due order filter coefficients of the FIR filter element 22*c* so as to calculate such impulse response that the instantaneous error signal becomes minimum.

As adaptive algorithm for renewing the impulse response, LSM algorithm is commonly known. Therefore, it is adapted in this embodiment of the present invention. It is known that the LMS algorithm is not severe in analysis but small in signal processing amount to work well. It is fit for practical use since it is possible to carry out a little more than twice in processing amount in comparison with FIR filter of fixed coefficient. The renewal of filter coefficients by the LMS algorithm is represented by the following formula (1).

Formula 1

$$W_{k+1}=W_k+2\mu\epsilon_k X_k \tag{1}$$

Herein, Wk is a filter coefficient and Xk is an input signal, each being a vector (degree=number of filter tap). The subscript k indicates the time of sample and $\epsilon k$ is an instantaneous error. $\mu$ is a step size parameter relating to the velocity of adaptation (convergence) and usually an extent of 0.01-0.001 is selected. Herein, in order to correct the condition that the corrected amount of Wk depends on an input amplitude, there is known a method (Normalized LSM algorithm) replacing $\mu$ with the following formula (2). In this embodiment of the present invention the method is adopted.

Formula 2:

$$\mu=\frac{u}{(L+1)\sigma^2} \tag{2}$$

Herein, $\sigma^2$ is (an assessed value of) an average power of the input signal Xk to be obtained by time constant processing an instantaneous power of the input signal Xk. (L+1) is the number of filter tap. u is a constant. If the constant is large, adaptation becomes fast, but if it is too large, the filter characteristic does not converge but oscillates. In the embodiment of the present invention, an extent of about 0.1-0.01 was better. Including all of the above, the formula of renewal of the filter factor is represented by the following formula (3).

Formula 3:

$$W_{k+1}=W_k+\frac{2u}{(L+1)\sigma^2}\varepsilon_k X_k \tag{3}$$

Also, $\sigma^2$ is calculated successively by the following formula (4).

Formula 4

$$\sigma_k^2=\alpha x_k^2+(1-\alpha)\sigma_{k-1}^2 \tag{4}$$

Herein, xk is an input signal and $\alpha$ is a constant relating to a time constant, whose relation is represented by $\alpha=1-e^{-1/(fs\cdot\tau)}$, wherein fs is a sampling frequency and $\tau$ is a time constant. In the embodiment of the present invention, the following values are given: fs=16,000 Hz and $\tau$=10 ms.

Further, the output signal of the impulse response calculation element 22*b* is also inputted to the synchronization determination element 23*a*. The output signal of the synchronization determination element 23*a* is inputted to the delay amount controlling element 23*b* so as to control the delay amount of the delay means 24. It is necessary to insert delay amount which corresponds to time delay due to the adaptive filter into the hearing aid signal. The impulse response being formed within the adaptive filter 22 comes to the peak in such a position as delayed for this delay amount. If this delay amount is too small, it is not possible to generate ideal impulse response thereby deteriorating the precision of adaptation. On the other hand, if the delay amount is too large, unnecessary time delay is caused.

In digital hearing aids, it is preferable to minimize the delay amount. Therefore, the impulse response is monitored and, when amplitude of the beginning part thereof is small, automatic adjustment processing is carried out to reduce the delay amount.

Further, the output signal of the impulse response calculation element 22*b* also is inputted to the maximum value determination element 25*a*. The output signal of the maximum value determination element 25*a* is inputted to the amplification amount adjusting element 25*b* so as to adjust the amplification rate of the variable amplification element 25*c*. In the case where the size of the external ear canal is above the average, etc., there is a possibility that the FIR filter element 22*c* or the variable amplification element 25*c* becomes saturated. To solve this, the maximum amplitude value of the impulse response formed within the adaptive filter is monitored (excessive value detection), and, if the value is excessive, the amplification gain of the amplitude adjusting means 25 is adjusted. This also may be solved by adjusting the level of the output signal of the hearing aid processing means 21 or the external ear canal microphone 7. Namely, it is required that automatic adjustment is carried out to obtain the predetermined output level while maintaining a linear operation without saturation of the variable amplification element 25*c* and the FIR filter element 22*c*.

Although the hearing aid to be fitted in the ear (ITE) is described in the embodiment of the present invention, it will be understood that the present invention can be applied to hearing aids of other configuration such as an behind the ear (BTE) type, etc. In the case of the BTE type hearing aid, two through-holes are provided in an earplug, and each of the through-holes is connected to the output sound port 2*a* and the external ear canal sound port 2*b* in parallel through a tube. Further, it is possible to have the earphone 6 and the external ear canal microphone 7 arranged not within the hearing aid body but within the earplug in such a manner that the earphone 6 and the external ear canal microphone 7 within the earplug are electrically connected to the DSP 5 arranged in the hearing aid body.

APPLICABILITY TO THE INDUSTRY

As described above, the quality of the sound within the external ear canal is able to approach the quality of the environmental sound, so that the uncomfortable feeling due to the hermetical sealing of the external ear canal can be reduced. Also, as the external ear canal itself is in a occluded condition, the acoustic feedback (howling) does not occur even if the adequate sound pressure is transmitted to the eardrum. Thus, it is possible to provide the hearing aid which is capable of obtaining the comfortable feeling to use. Further, the indistinct feeling can be reduced so that it is possible to apply to an audio-earphone and a portable head set.

Although there have been described what are the present embodiments of the invention, it will be understood that variations and modifications may be made thereto within the scope of the claims appended hereto.

The invention claimed is:

1. A hearing aid comprising:

a microphone for converting an environmental sound to an electric signal;

a hearing aid processor for hearing aid processing of an output signal of said microphone;

an earphone for converting an output signal of said hearing aid processor to a sound signal;

an external ear canal microphone for converting a sound within an external ear canal to an electric signal; and a signal processor for comparing an output signal of said external ear canal microphone and the output signal of said hearing aid processor and for automatically adjusting the output signal of said hearing aid processor such that the output signal of said external ear canal microphone approaches the output signal of said hearing aid processor, wherein said signal processor comprises an adaptive filter, the output signal of said hearing aid processor functions as an input signal xk and a desired signal dk of said adaptive filter, and the output signal of said external ear canal microphone functions as a response signal yk of said adaptive filter.

2. The hearing aid according to claim 1, further comprising a delay device for having the desired signal dk delayed for a predetermined time.

3. The hearing aid according to claim 2 further comprising a delay amount controlling device for monitoring an impulse response of said adaptive filter and, when a maximum value in the beginning part of the impulse response is below a predetermined value, decreasing a delay amount of said delay device.

4. The hearing aid according to claim 2, further comprising an amplitude adjusting device for monitoring an impulse response of said adaptive filter and, when a maximum value of the impulse response exceeds a predetermined value, adjusting automatically one or more of amplitudes with respect to the output signal of said microphone, the output signal of said hearing aid processor, said output signal of the external ear canal microphone and a driving signal of said earphone.

5. The hearing aid according to claim 1, further comprising an amplitude adjusting device for monitoring an impulse response of said adaptive filter and, when a maximum value of the impulse response exceeds a predetermined value, adjusting automatically one or more of amplitudes with respect to the output signal of said microphone, the output signal of said hearing aid processor, said output signal of the external ear canal microphone and a driving signal of said earphone.

6. The hearing aid according to claim 5 further comprising a delay device for having the desired signal dk delayed for a predetermined time and a delay amount controlling device for monitoring the impulse response of said adaptive filter and, when a maximum value in the beginning part of the impulse response is below a predetermined value, decreasing a delay amount of said delay device.

7. The hearing aid according to claim 1, further comprising a frequency weighting device for imposing a predetermined frequency weight on to remove from the output signal of said external ear canal microphone a component of sound signal propagated from a vent into the external ear canal.

8. The hearing aid according to claim 1, further comprising a frequency characteristic correcting device for correcting a frequency response of said external ear canal microphone.

9. The hearing aid according to claim 1, further comprising a frequency weighting device for imposing a predetermined frequency weight on to remove from the output signal of said external ear canal microphone a component of sound signal propagated from a vent into the external ear canal.

10. The hearing aid according to claim 1, further comprising a frequency characteristic correcting device for correcting a frequency response of said external ear canal microphone.

* * * * *